US005974670A

United States Patent [19]

Hsieh

[11] Patent Number: 5,974,670

[45] Date of Patent: Nov. 2, 1999

[54] MULTIPURPOSE TOOL

[76] Inventor: Chih-Ching Hsieh, No. 64, Lane 107, Liang Tsun Rd., Fong Yuan City, Taichung Hsien, Taiwan

[21] Appl. No.: 08/961,267

[22] Filed: Oct. 30, 1997

[51] Int. Cl.[6] ..... B26B 13/00

[52] U.S. Cl. ..... 30/252; 30/259; 30/271; 30/145

[58] Field of Search ..... 30/145, 252, 259, 30/271

[56] References Cited

U.S. PATENT DOCUMENTS

| | | | |
|---|---|---|---|
| 109,192 | 11/1870 | Dubois | 30/145 |
| 3,596,355 | 8/1971 | Wertepny | 30/252 |
| 3,885,309 | 5/1975 | Lund et al. | 30/252 |
| 5,184,404 | 2/1993 | Chen | 30/252 |

*Primary Examiner*—M. Rachuba
*Attorney, Agent, or Firm*—Varndell & Varndell, PLLC

[57] ABSTRACT

A multipurpose tool having two pivoted cutter blades turned with two handles to act agaisnt each other, wherein a ratchet block is turned about a pivot at a front end of one handle and fixedly fastened to one end of one cutter blade, a stop block is pivotably mounted in one handle and turned by a rotary cap through a link between a first position where the cutter blades are allowed to be opened by moving the handles, a second position where the cutter blades are allowed to be closed by moving the handles, and a third position where the cutter blades are remained immovable when the handles are moved relative to each other.

5 Claims, 5 Drawing Sheets

MULTIPURPOSE TOOL

BACKGROUND AND SUMMARY OF THE INVENTION

The present invention relates to multipurpose tools, and more particularly to such a multipurpose tool which can be adjusted between different modes, and operated to cut different items of different sizes or to strip electrical wires.

FIG. 1 shows a conventional shearing tool designed for cutting steel ropes. This shearing tool is comprised of two handles pivoted together by a pivot, and two cutter blades respectively integral with the handles at one end. When the handles are pushed together from an opened positioned, the cutter blades are moved against each other to cut things. This structure of shearing tool is suitable for cutting objects of diameters within a limited range only. When the cutter blades are fully opened for cutting a workpiece having a big diameter, the distance between the handles is maximized, and force can not be efficiently employed to the cutter blades through the handles. Further, this structure of shearing tool is not practical for use in stripping electrical wires, or cutting small items.

The present invention has been accomplished in view of the deficiencies in the prior art. It is one object of the present invention to provide a multipurpose tool which can be conveniently and efficiently operated to cut things of different diameters. It is another object of the present invention to provide a multipurpose tool which is suitable for cutting steel ropes, steel cables, rivets and nails, as well as stripping electrical wires. According to one aspect of the present invention, the multipurpose tool comprises two pivoted cutter blades moved with two handles to act against each other, wherein a ratchet block is turned about a pivot at a front end of one handle and fixedly fastened to one end of one cutter blade, a stop block is pivotably mounted in one handle and turned by a rotary cap through a link between a first position where the cutter blades are allowed to be opened by turning the handles, a second position where the cutter blades are allowed to be closed by turning the handles, and a third position where the cutter blades are remained immovable when the handles are turned relative to each other. According to another aspect of the present invention, the cutter blades have a respective first cutter edge at one end adapted for cutting steel ropes and cables, a second cutter edge at an opposite end adapted for cutting rivets and nails, and a third cutter edge in the middle adapted for stripping electrical wires.

DETAILED DESCRIPTION OF THE PREFERRED EMBODIMENT

Figure 1:
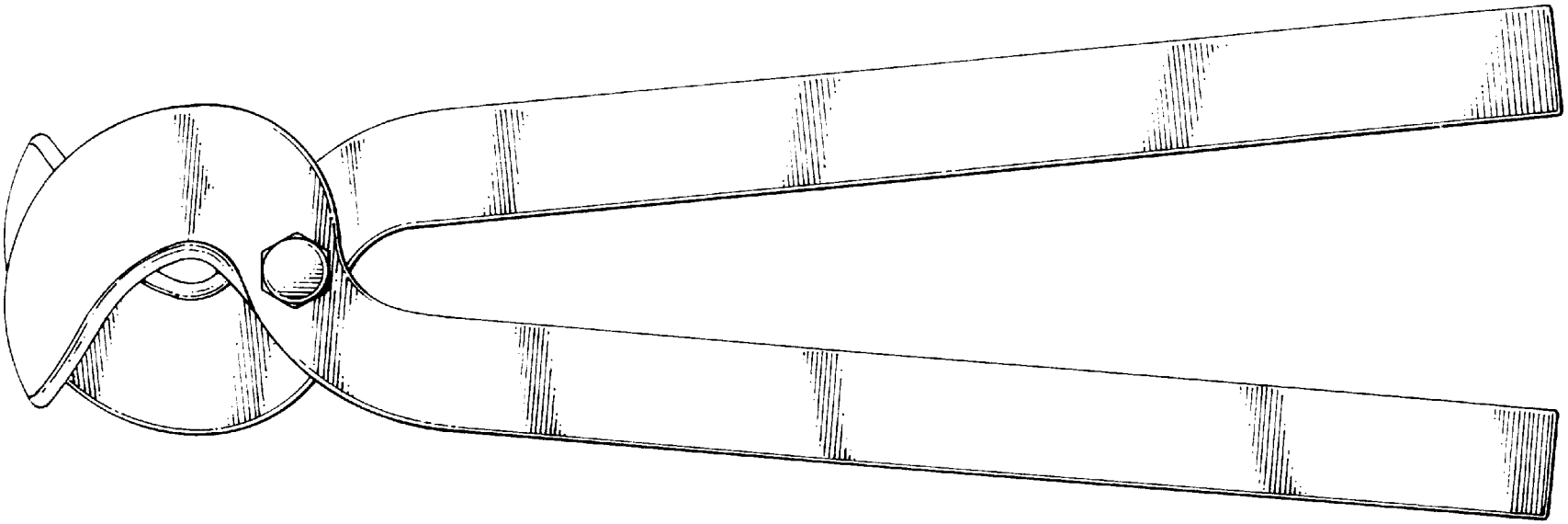
Fig. 1 PRIOR ART
FIG. 1 is a plain view of a steel rope shearing tool according to the prior art.
Figure 2:
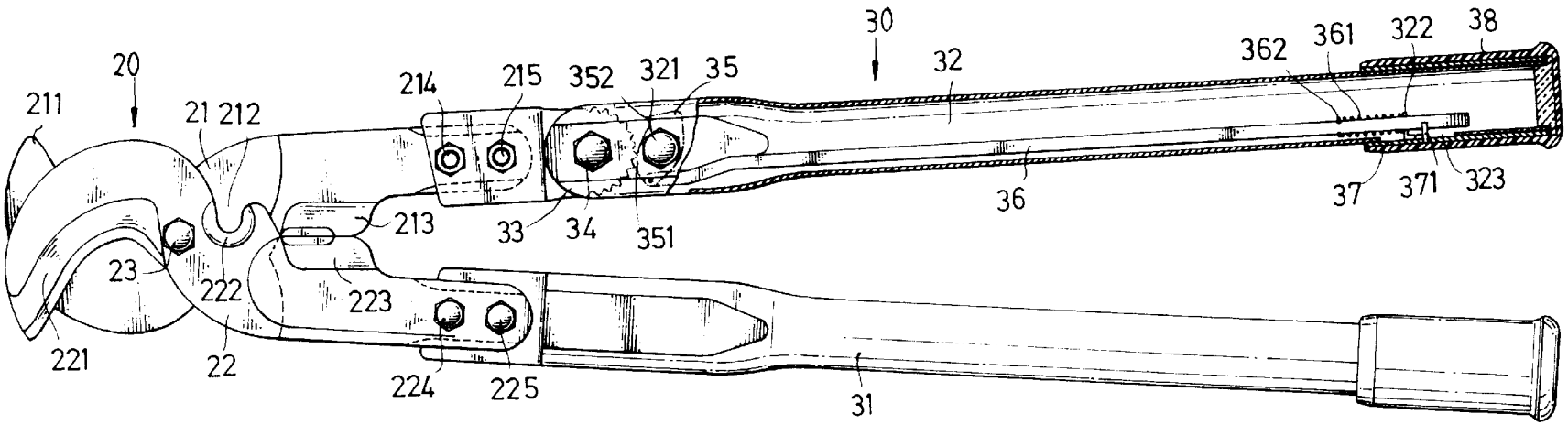
FIG. 2 is a plain view with a part in sectional view of a multipurpose tool according to the present invention.
Figure 3:
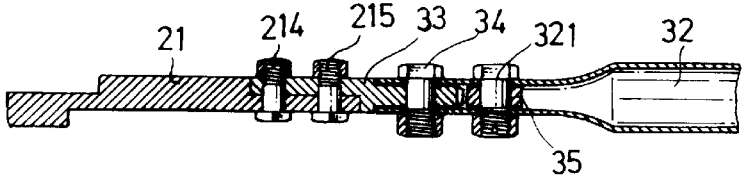
FIG. 3 is a sectional view of a part of FIG. 2, showing the connection between the first blade and the second handle.

Referring to FIGS. 2 and 3, a multipurpose tool comprises a cutter unit 20 at its front end, and a handle unit 30 at its rear end. The cutter unit 20 comprises two cutter blades, namely, the first cutter blade 21 and the second cutter blade 22 pivoted together by a pivot 23, and turned to act against each other. The cutter blades 21, 22 comprise a respective first cutting edge 211; 221 at one end adapted for cutting steel ropes and cables, a respective second cutting edge 213, 223 at an opposite end adapted for cutting rivets or screw nails, and a respective third cutting edge 212, 222 in the middle adapted for stripping electrical wires.

The handle unit 30 comprises two handles, namely, the first handle 31 and the second handle 32 respectively connected to the cutter blades 21; 22 of the cutting unit 20. The second handle 32 is a hollow bar. The first handle 31 is fixedly connected to the second cutter blade 22 by two screws 224, 225. The second handle 32 has a front end pivotably mounted with a ratchet block 33 by a pivot 34. The ratchet block 33 has a front end fixedly fastened to the first cutter blade 21 by two screws 214, 215. A stop block 35 is pivotably mounted inside the second handle 32 by a pivot 321. The stop block 35 has a first pawl 351 and a second pawl 352 adapted to engage with the ratchet block 33 alternatively. A link 36 is mounted inside the second handle 32. The link 36 has a front end connected to the stop block 35, and a rear end passing through a hole in a L-shaped block 322 inside the second handle 32. A stop ring 362 is fixedly mounted around the link 36. A spring 361 is mounted around the link 36, and stopped between the stop ring 362 and the L-shaped block 322. The spring 361 imparts a forward pressure to the link 36, thereby causing the stop block 35 to be forced into engagement with the ratchet block 33. A key 371 is provided having a bottom end fixedly connected to the rear end of the link 36, and a top end inserted through an opening in the second handle 32 and into a beveled sliding slot 323 on the a rotary cap 37. The rotary cap 37 is mounted on the rear end of the second handle 32, and covered with a plastic covering 38.

Figure 4:
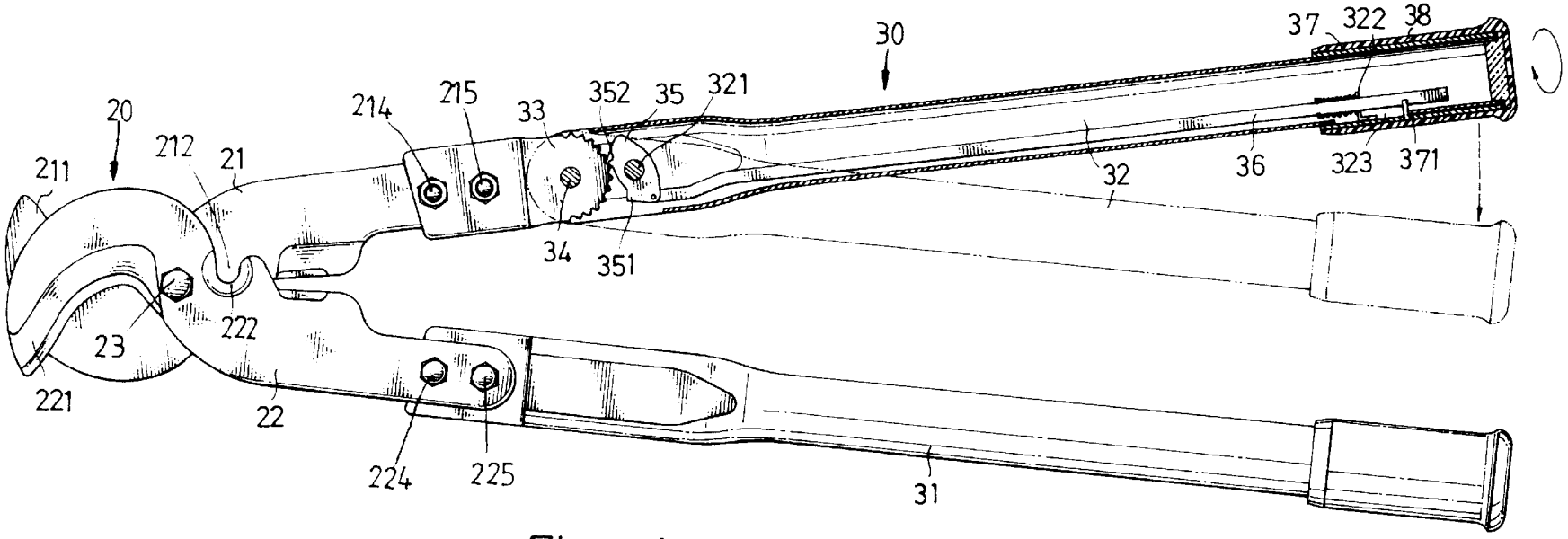
FIG. 4 is an applied view of the present invention, showing the second pawl of the stop block forced into engagement with the ratchet block.
Figure 5:
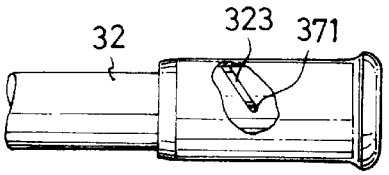
FIG. 5 is an enlarged view of a part of the second handle according to the present invention, showing the key moved to the lower center in the bevel sliding slot.

Referring to FIGS. 4 and 5, when to open the cutter blades 21, 22 for cutting a workpiece (steel rope or cable), the plastic cover 38 (the rotary cap 37) is rotated counter-clockwise about its axis to move the key 371 along the bevel sliding slot 323 to the low center, causing the link 36 to be moved in a direction toward the ratchet block 33, therefore the stop block 35 is pivoted by the link 36 counter-clockwise about pivot 321, and the first pawl 352 of the stop block 35 is forced into engagement with the ratchet block 33. When the second handle 32 is moved away from the first handle 31 at this stage, the first cutter blade 21 is opened from the second cutter blade 22 for permitting the workpiece to be caught by the cutter unit 20. If the second handle 32 is moved toward the first handle 31, the stop block 35 is immediately forced away from the ratchet block 33 for permitting the second handle 32 to be moved toward the first handle 31 without moving the first cutter blade 21, relative to the second cutter blade 22.

Figure 6:
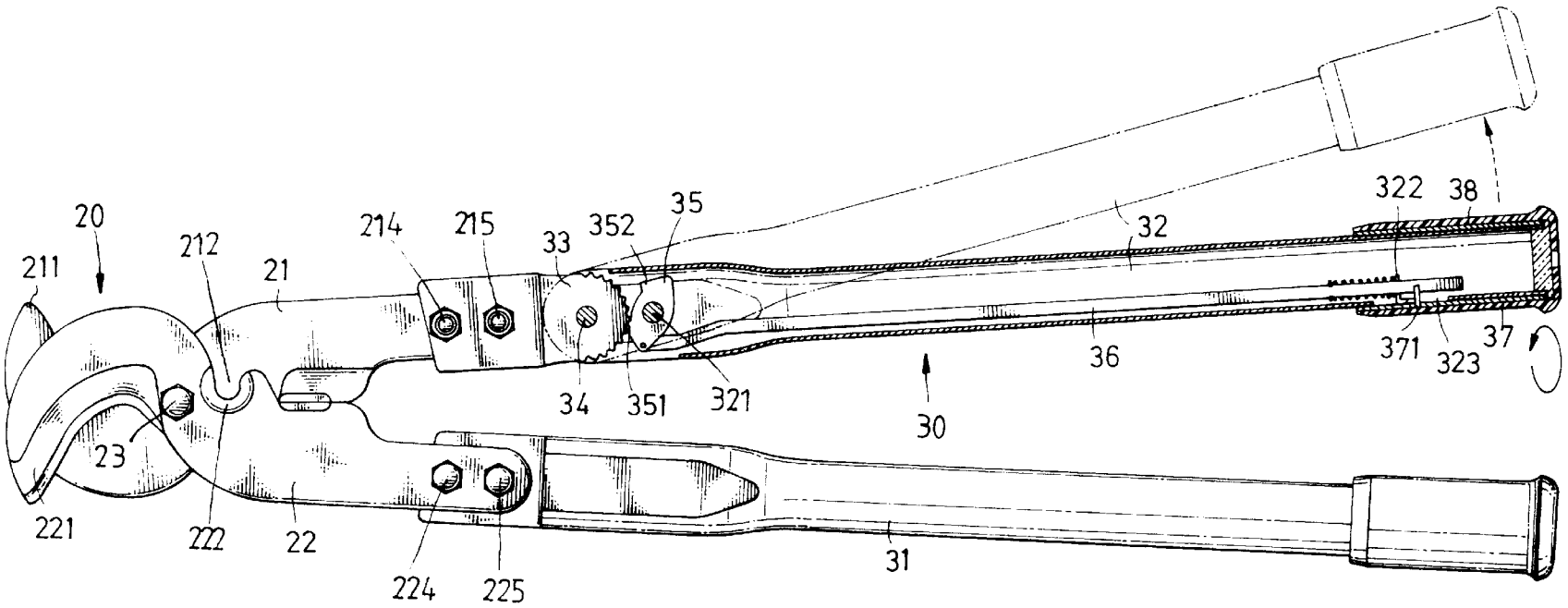
FIG. 6 is another applied view of the present invention, showing the first pawl of the stop block forced into engagement with the ratchet block.
Figure 7:
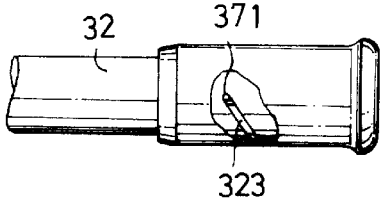
FIG. 7 is an enlarged view of a part of the second handle according to the present invention, showing the key moved to the top center in the bevel sliding slot.

Referring to FIGS. 6 and 7, after the workpiece has been clamped between the cutter blade 21; 22, the plastic cover 38 (the rotary cap 37) is rotated clockwise about its axis to move the key 371 along the beveled sliding slot 323 to the top center, causing the link 36 to be moved in the reversed direction away from ratchet block 33, and therefore the stop block 35 is provided by link 36 clockwise about pivot 321, and the first pawl 351 of the stop block 35 is forced into engagement with the ratchet block 33. When the second handle 32 is moved toward the first handle 31, the first cutter blade 21 and the second cutter blade 22 act against each other to cut the workpiece. When the second handle 32 is moved away from the first handle 31 after cutting, the stop block 35 is forced to disengage from the ratchet block 33, and the first cutter blade 21 remains immovable when the second handle 32 is moved away from the first handle 21.

Figure 8:
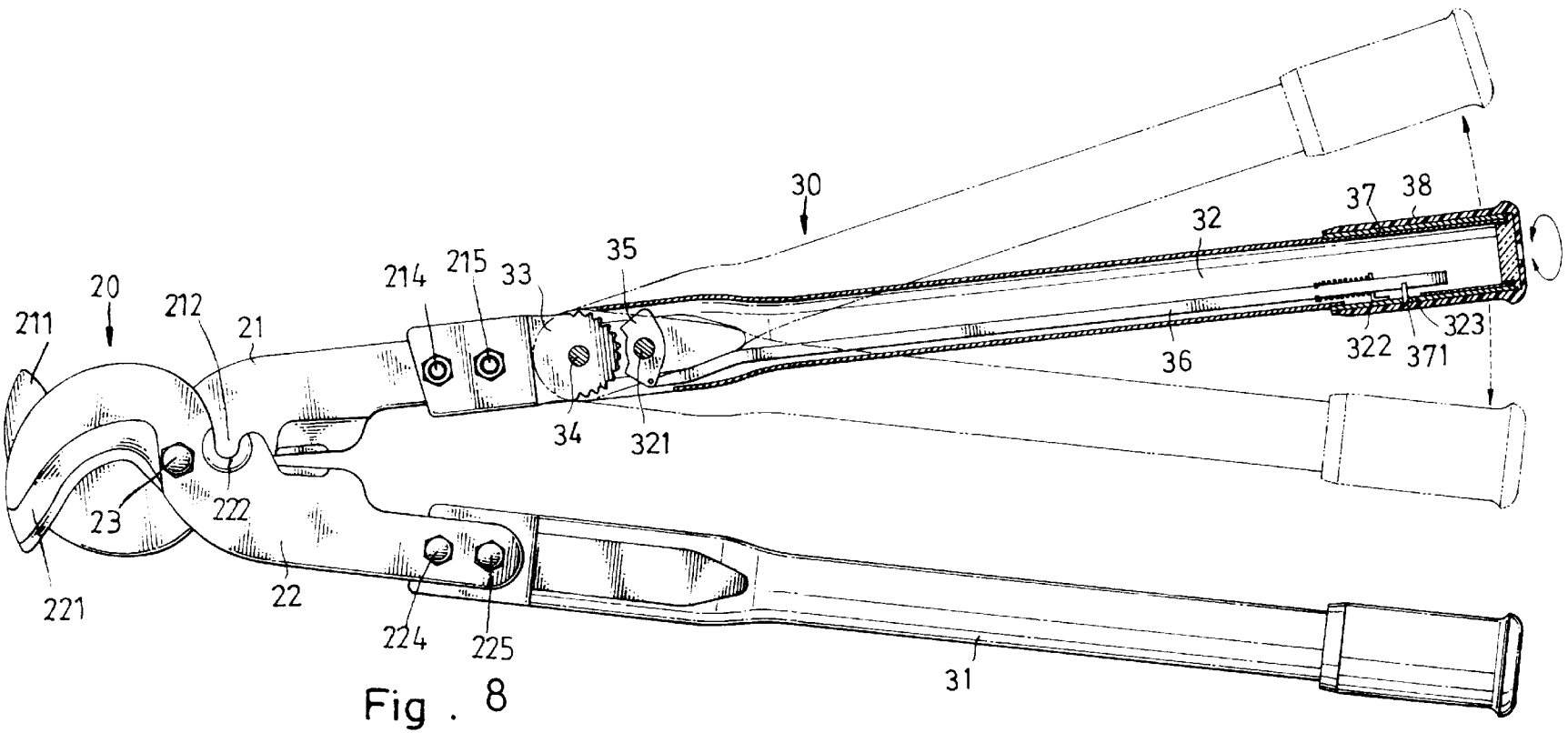
FIG. 8 is still another applied view of the present invention, showing the stop block disengaged from the ratchet block and moved to the neutral posotion.
Figure 9:
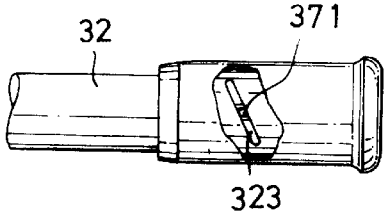
FIG. 9 is an enlarged view of a part of the second handle according to the present invention, showing the key spaced between the top center and the lower center in the bevel sliding slot.

Referring to FIGS. 8 and 9, when the plastic cover 38 (the rotary cap 37) is rotated for moving the key 371 along the bevel sliding slot 323 to a midpoint between the top center and the low center, the stop block 35 is disengaged from the ratchet block 33. Namely, the stop block 35 is placed in an idle running position, permitting the second handle 32 to be moved towards and away from the first handle 31 to the desired angle without moving the first cutter blade 21. After the second handle 32 has been moved to the desired angle, the plastic cover 38 (the rotary cap 37) can be turned clockwise to the status shown in FIG. 6, for permitting the cutter blades 21, 22 to be opened.

I claim:

1. A multipurpose tool comprising a cutter unit at one end and a handle unit at an opposite end, said handle unit having first and second handles controlled to drive said cutter unit for cutting things, said cutter unit comprising a first cutter blade and a second cutter blade pivoted together by a first pivot and rotated about said pivot to act against each other for cutting things, said first cutter blade and said second cutter blade having a first end with a respective main cutting edge for cutting things and a second end respectively connected to said first and second handles of said handle unit, said second cutter blade connected to said second handle by a second pivot, said second cutter blade having a ratchet block fixed at said second end thereof, a stop block being mounted in a first end of said second handle and adapted to engage said ratchet block, a link being mounted in said second handle and connected on one end of said stop block; said link movable in a longitudinal direction of said second handle between a first position where said stop block is forced into engagement with said ratchet block so that said first cutter blade moves with said second handle away from said second cutter blade for opening said cutter unit by moving said second handle toward to said first handle, a second position where said stop block is forced into engagement with said ratchet block so that said first cutter block moves toward said second cutter blade for closing said cutter unit by moving said second handle away from said first handle, and a third position where said first cutter blade and said second cutter blade are immovable when said second handle is moved relative to said first handle.

2. The multipurpose tool of claim 1, wherein said second handle has a side with an opening and a rear end, a rotary cap is mounted on said rear end and rotatable about an axis of said second handle, said rotary cap having a beveled sliding slot adjacent said opening of said second handle; said link has a key extending outward, passing through said side opening of said second handle and sliding in said beveled sliding slot of said rotary cap; said key of said link moving along said beveled sliding slot when said rotary cap is rotated about said axis of said second handle, causing said stop block to be pivoted by said link.

3. The multipurpose tool of claim 1, wherein said first cutter blade and said second cutter blade have a respective straight cutting edge at an opposite end adapted for cutting small items.

4. The multipurpose tool of claim 3, wherein said first cutter blade and said second cutter blade have a respective arched cutting edge disposed in the middle adjacent to said first pivot and adapted for stripping electrical wires.

5. The multipurpose tool of claim 1, wherein a spring is mounted around said link to impart a forward pressure to said link, said spring having one end connected to a stop ring being fixedly mounted on said link, and a rear end connected to a L-shaped block raised from an inside wall of said second handle.

* * * * *